United States Patent [19]

Downing et al.

[11] 4,138,621

[45] Feb. 6, 1979

[54] SHORT-ARC DISCHARGE LAMP WITH STARTING DEVICE

[75] Inventors: Robert D. Downing, Mentor; John C. Sobieski, Richmond Heights, both of Ohio

[73] Assignee: General Electric Company, Schenectady, N.Y.

[21] Appl. No.: 810,272

[22] Filed: Jun. 27, 1977

[51] Int. Cl.[2] ..... H01J 5/16; H01J 61/54

[52] U.S. Cl. ..... 313/113; 313/198; 313/201

[58] Field of Search ..... 313/198, 201, 113, 234

[56] References Cited

U.S. PATENT DOCUMENTS

| | | | |
|---|---|---|---|
| 2,627,046 | 1/1953 | Lemmers | 313/234 |
| 3,610,983 | 10/1971 | Grabner et al. | 313/201 X |
| 4,053,809 | 10/1977 | Fridrich et al. | 313/201 X |

FOREIGN PATENT DOCUMENTS 2420811 11/1975 Fed. Rep. of Germany.

*Primary Examiner*—Palmer C. Demeo
*Attorney, Agent, or Firm*—Norman C. Fulmer; Lawrence R. Kempton; Frank L. Neuhauser

[57] ABSTRACT

A short-arc discharge lamp having a pair of electrodes sealed through stems into a bulb, and an external starting device comprising an electrical conductor extending from the vicinity of the stem of one of the electrodes to the vicinity of the stem of the other electrode.

7 Claims, 7 Drawing Figures

SHORT-ARC DISCHARGE LAMP WITH STARTING DEVICE

CROSS-REFERENCE TO RELATED APPLICATION

Ser. No. 697,426, filed June 18, 1976, Fridrich and Bergman, "Short-Arc Discharge Lamp With Starting Device," assigned the same as this invention and now U.S. Pat. No. 4,053,809.

BACKGROUND OF THE INVENTION

The invention is in the field of short-arc high-intensity gas discharge lamps, such as are used in certain photographic projectors. It is common practice to manufacture integral lamp and reflector combinations employing such a type of lamp.

A typical short-arc high-intensity discharge lamp comprises a quartz envelope having a thick-wall bulb-like arc chamber, and a pair of elongated electrodes are sealed into stems extending from the envelope at opposite ends and along a common axis. The envelope includes elongated stems extending along and around portions of the electrodes. The arc length between the inner ends of the electrodes is about 2 or 3 millimeters, and the overall bulb diameter is about 8 to 10 millimeters, and overall length (including stems) is about 5 centimeters, for a 300-watt metal halide gas lamp. U.S. Pat. No. 3,379,868 to Taillon discloses a short-arc lamp mounted in a reflector laterally of the projected light's optical axis, and U.S. Pat. No. 3,700,881 to Slomski discloses a short-arc lamp mounted in a reflector along the optical axis. U.S. Pat. No. 3,780,342 to Grimshaw et al discloses a ballast circuit for a short-arc lamp, which applies a relatively high starting voltage pulse to the lamp electrodes, followed by a relatively lower operating voltage. The above-referenced patent application discloses such a lamp having a starting aid comprising a conductor connected electrically to one of the electrodes and extending to the vicinity of the stem containing the other electrode.

SUMMARY OF THE INVENTION

The principal object of the invention is to improve the starting characteristics of short-arc lamps so they will start more reliably and/or at a lower value of starting voltage, and to accomplish this in an inexpensive manner.

The invention comprises, briefly and in a preferred embodiment, a short-arc type of lamp having a bulb portion, a pair of elongated electrodes extending into the bulb portion and sealed through stems extending outwardly from the bulb portion and along and surrounding portions of the electrodes, and an external conductive starting device extending from the vicinity of one sealing stem to the vicinity of the other sealing stem. Preferably, the inner surfaces of the stems are slightly spaced from the surfaces of the electrodes between the bulb and junction points at which the stems make contact against the electrodes, and the starting device comprises conductive bands respectively surrounding the stems at their junction points with the electrodes.

DESCRIPTION OF THE PREFERRED EMBODIMENTS

Figure 1:
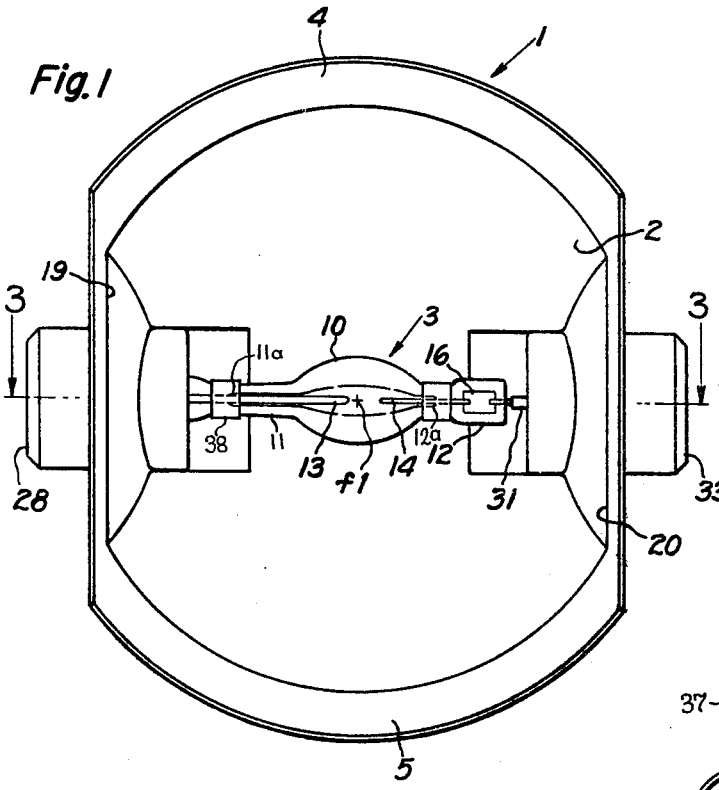
FIG. 1 is a front view of a lamp and reflector combination in accordance with a preferred embodiment of the invention.
Figure 2:
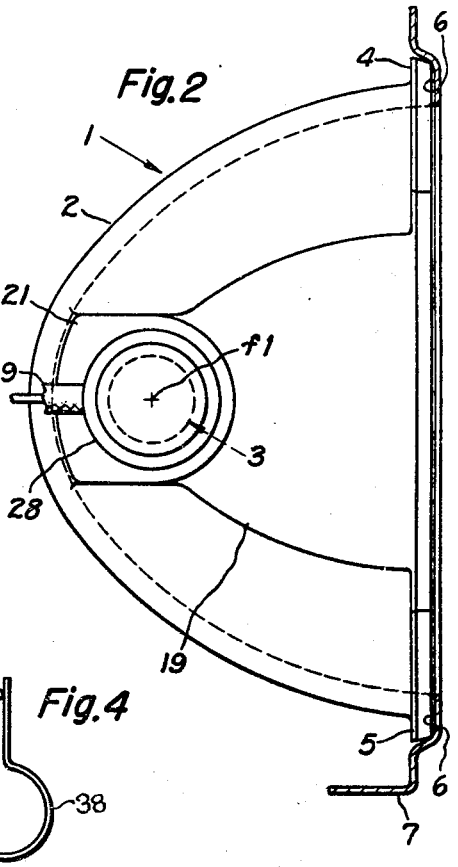
FIG. 2 is a side view of FIG. 1.
Figure 4:
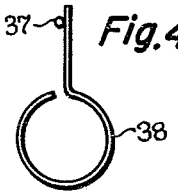
FIG. 4 is an axial view of the starting aid shown in FIGS. 1 and 3.

Referring to FIGS. 1-4 of the drawings, there is illustrated a projection lamp unit 1 comprising a reflector portion 2, preferably made of glass and molded to an ellipsoidal shape, having a light source in the form of an arc tube 3 at its near focus f1. The ellipsoidal shape of the reflector concentrates the light at the far focus which conveniently may be located in front of the rim seating plane of the light unit at a distance about equal to the diameter across the rim. The reflector is provided with two flange segments 4, 5 at its rim by which the lamp is supported against a cooperating seating shoulder 6 in a support member 7 as shown in FIG. 2. By using a glass reflector, dimensional stability is assured. Also, it may be coated on its inner surface with a reflecting coating 8 consisting of a known type of multiple layer interference film which is highly reflective of visible light but transmissive of heat or infrared radiation. A metal reflector with a conventional mirror finish may also be used.

The light source or arc tube 3 comprises a quartz envelope having a generally spherical central portion or bulb 10 provided with generally cylindrical outwardly extending extensions or stems 11, 12 having outer diameters considerably less than that of the bulb 10. The electrodes 13, 14 consist of lengths of tungsten wire which are welded to molybdenum foils 15, 16, the foils in turn being welded to inleads 17, 18. The foils are wetted by the quartz of the stems to provide hermetic seals. The ilustrated lamp is intended for direct-current operation and the anode 13 is of tungsten wire larger in diameter and longer than the cathode 14. In a lamp for a-c operation, the two electrodes would be of the same size and the stems would be equal in length. The lamp operates with the electrodes close to the melting point of tungsten and may operate with substantially molten tips resulting in the rounding and balling of the electrode ends during operation. The lamp contains an ionizable filling which includes an inert gas such as argon and halogen or metal halide such as indium iodide. By way of example, the overall length of the arc tube quartz body may be 5 centimeters, and the outside diameter of the bulb portion may be 9 millimeters with the internal diameter of the discharge space being about 2.5 millimeters and the arc length between the inner ends of the electrodes being about 2.5 millimeters. The inner surfaces of the stems 11 and 12 are spaced slightly from the outer surfaces of the electrodes 13 and 14, as shown, for example about one millimeter or less, from the bulb 10 outwardly along the stems to junction points **11*a* and 12*a*** after which the stems make contact against the electrodes (but not hermetic seal contact because the quartz stems cannot "wet" the tungsten electrodes).

Figure 3:
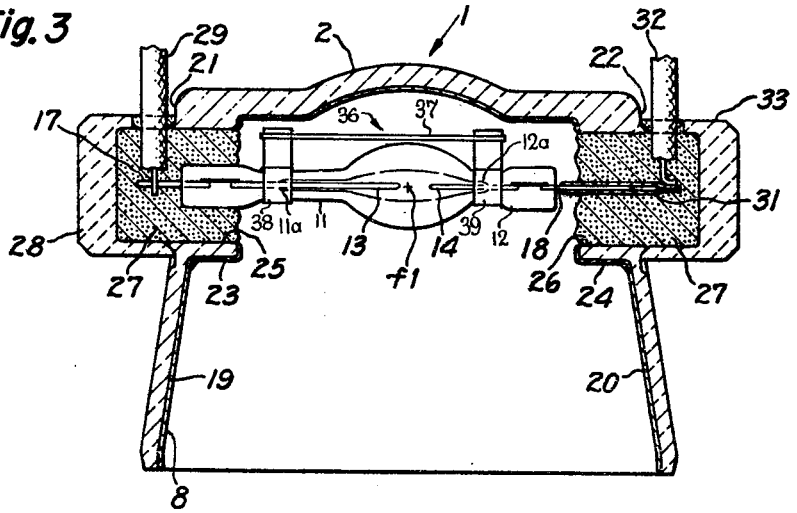
FIG. 3 is a cross-sectional view taken on the line 3—3 of FIG. 1.

Segments are cut away from the sides of the reflector 2 leaving flat vertical side walls 19, 20 which are chord-like in end view as seen in FIG. 1 and tapered rearward slightly towards the axis in plan section as seen in FIG. 3. In the front half of the reflector, the chord-like side walls 19, 20 cut into the normal elliptical curve of the reflector surface, but in the rear half, they are extended into shoulders 21, 22 defining generally wedge-like expansions within the reflector. Within the shoulder expansions, the glass is built up into collars 23, 24 about lateral apertures 25, 26 through the chord walls; the apertures are centered on a line passing through focus f1 and transverse to the optical axis.

Arc tube 3 is mounted laterally of the reflector's optical axis with stem 11 projecting into aperture 25 and set in a glassy cement 27 which fills the volume of the aperture and of a ceramic cap 28 which is placed over the opening. An insulated wire lead 29 is welded to the end of inlead 17 and emerges from cap 28 through a small side aperture at the rear. The stem 12 at the cathode end of the arc tube does not penetrate into aperture 26; a snug-fitting sleeve 31 is provided around inlead 18 and the sleeve projects into lateral aperture 26 and is there set in cement 27. An insulated wire lead 32 is connected to the end of sleeve 31 and emerges from cap 33 through a side aperture to the rear. Before cement 27 sets hard, arc tube 3 is adjusted to optically center the arc at the near focus f1 while the lamp unit as a whole is accurately located relative to the projection system by the flange segments 4, 5. Preferably, a cement is used which sets quickly under heat and bonds to both the glass reflector and the quartz arc tube. One suitable cement comprises primarily fine alumina and calcined kaolin along with minor additions of disodium phosphate and trialuminum phosphate mixed with phosphoric acid to form a paste.

By setting one end of arc tube 3 in cement so that it is rigidly fixed to reflector 2, a projection lamp unit results wherein the arc tube is accurately located in an optical reference system. When subsequently the unit is inserted into a socket properly accommodating flange segments 4, 5, it will provide the desired light at the film gate without further adjustment. At the other end of the arc tube, the inlead is slidably engaged in sleeve 31. This permits differential expansion of the quartz arc tube having a low coefficient of expansion and of the glass reflector having a relatively high coefficient of expansion, without subjecting the parts to excessive strain. At the same time, the displacement of the interelectrode gap relative to the reflector focus as a result of differential thermal expansion is too slight to be of any consequence in the optics of the system. The projector lamp thus far described is similar to that disclosed in the above-referenced Taillon patent. As mentioned above, the lamp 3 requires a ballast circuit which applies a relatively high value of starting voltage (about 8,000 to 10,000 volts).

In accordance with the present invention, the starting voltage of the lamp 3 is reduced and/or the lamps start more reliably by providing a starting aid device 36 comprising an elongated electrically conductive member extending from the vicinity of one stem 11 to the vicinity of the other stem 12. In the preferred embodiment shown, the starting device 36 comprises a wire 37 welded or otherwise attached at one end thereof to a metal strap 38 which fits tightly around and encircles the stem 11. The wire 38 extends along and behind the lamp 3, between the lamp and the rear surface of the reflector, and is welded or otherwise attached to a metal strap 39 which fits tightly around and encircles the stem 12 of the anode electrode 13. This starting device 36 is thus held in place and supported at both ends thereof, and, being positioned behind the lamp 3, has no appreciable effect on the light output of the lamp-reflector combination. The starting device 36 is not directly connected electrically, and thus is electrically "floating." The wire 37 can be spaced away from the discharge bulb.

Preferably, the starting aid straps 38 and 39 are positioned on the stems 11 and 12 respectively at and surrounding the locations of the junction points **11*a* and 12*a* where the stems meet and make contact with the electrodes 13 and 14. Such a location of the starting aid straps is found to improve the effectiveness of the starting aid by causing the lamps to start more reliably at lower starting voltages. To aid in optimum positioning of the starting aid bands 11*a* and 12*a*, they may be made sufficiently wide so as to axially flank the junction points 11*a* and 12*a*** to help insure that they will be at these junction points, as shown in the drawings.

By using the starting device 36 as shown and described above, the voltage for starting the lamp 3, which is known commercially as the General Electric Company MARC 300 projector lamp, was reduced to a value of about 4,000 to 6,000 volts, whereas without the starting device 36, the starting voltage was about 8,000 to 12,000 volts, for typical groups of production lamps, the starting pulse being a fast-rising d-c pulse having its positive polarity applied to the anode and its negative polarity applied to the cathode, and having a rise time of about one microsecond. Instead of providing the straps 38 and 39, the ends of the wire 37 can be bent around the stems 11 and 12.

Figure 5:
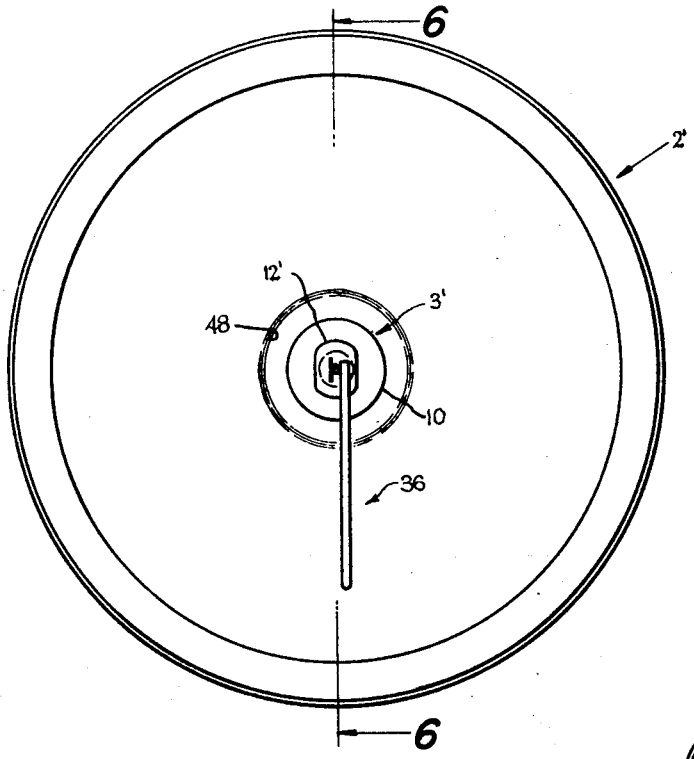
FIG. 5 is a front view of a lamp and reflector combination in accordance with another preferred embodiment of the invention.
Figure 7:
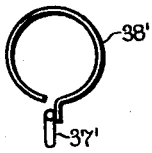
FIG. 7 is an axial view of the starting aid shown in FIG. 6.
Figure 6:
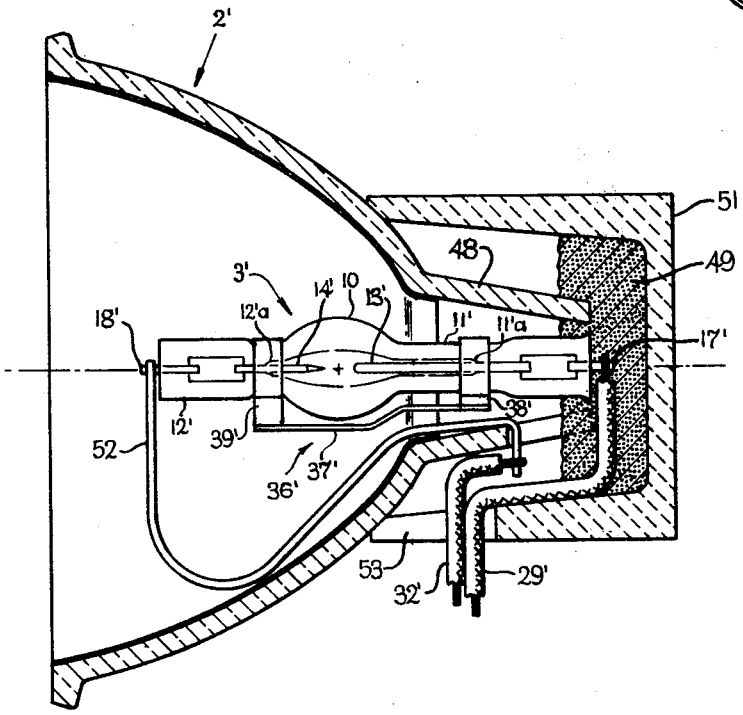
FIG. 6 is a cross-sectional view taken on the line 6—6 of FIG. 5.

In the embodiment of FIGS. 5, 6, and 7, the lamp 3' is the same as or similar to the lamp 3 described above, and is mounted along the optical axis of a concave reflector 2' having a circular configuration in all planes thereof perpendicular to the optical axis. The anode stem 11' of the lamp extends into a hollow collar 48 at the rear of the reflector, where it is cemented to the reflector by cement 49 which also holds a ceramic end cap 51 in place. A connector wire 29' is attached to the inlead 17' of the anode electrode, and a connector wire 32' is attached to an end of a stiff wire 52, curved as shown and with its other end connected to the cathode inlead 18'. The connector wires 29' and 32' are brought out of the end cap 51 through an opening. The embodiment of FIGS. 5 and 6, as thus far described, is similar to the projector lamp disclosed in the above-referenced Slomski patent.

In accordance with the present invention, the starting aid 36' comprises a wire 37' connected at an end thereof to a strap 38' which fits tightly around and encircles the anode stem 11', the other end of wire 37' being connected to a strap 39' which fits tightly around and encircles the cathode stem 12'. Preferably, these straps are at the junction points **11'*a* and 12'*a* where the stems come into contact against the electrodes, similarly as described above for the embodiment of FIGS. 1–4. The wire 37' preferably is aligned between the lamp 3' and connector wire 52 so as not to cause a shadow in addition to that caused by the connector wire 52**.

The starting aid wire 37 or 37' may be shaped in various convenient configurations, such as straight as shown in FIG. 3 or curved as shown in FIG. 6.

The invention achieves its objects of improving the starting of short-arc lamps, and in an inexpensive manner. The lamp starting aid of the present invention improves the lamps starting as well as the starting aid disclosed in the above-referenced patent application, and has the advantage thereover of not being connected to a lamp electrode. Such connection to an electrode is somewhat difficult to arrange in certain types of lamps such as the embodiment of FIGS. 1–4 in which there is a very small length of exposed inlead wire 18 between the stem 12 and cement 27. Another advantage of the invention over that of the above-referenced patent application is a reduction of electrical shock hazard, and reduced possibility of malfunctioning of the lamp in case of shorting of the starting aid against an object, the foregoing advantages being achieved by the starting aid not being connected to carry the high voltage of a lamp electrode.

While preferred embodiments and modifications of the invention have been shown and described, various other embodiments and modifications thereof will become apparent to persons skilled in the art and will fall within the scope of the invention as defined in the following claims.

What we claim as new and desire to secure by Letters Patent of the United States is:

1. An arc discharge lamp comprising an envelope having a bulb portion and first and second elongated stems respectively extending from said bulb portion, and first and second electrodes extending into said envelope and spaced apart in said bulb portion to define an arc discharge path, said first and second electrodes respectively being parts of first and second elongated electrode structures, respectively sealed in said first and second stems at regions thereof spaced from said bulb portion, the inner surfaces of said first and second stems being respectively spaced from said first and second electrodes therealong between said bulb portion and first and second junction points at which the stems make contact with the electrodes, said first and second junction points being located respectively between said bulb portion and said first and second electrode structure seals, wherein the improvement comprises a starting device of electrically conductive material positioned externally of said envelope and extending from the vicinity of said first junction point to the vicinity of said second junction point, said starting device not being connected to carry the voltage of either of said electrodes.

2. A lamp as claimed in claim 1, in which said starting device comprises conductive bands respectively substantially encircling said stems at said first and second junction points.

3. A lamp as claimed in claim 2, in which said conductive bands are sufficiently wide to axially flank said first and second junction points.

4. A lamp as claimed in claim 1, in combination with a concave reflector, said stems of the lamp extending from opposite ends of said bulb portion and lying on a common axis, said lamp being mounted in said reflector along an axis transverse to the optical light projection axis of the reflector, said starting device comprising an elongated conductor positioned between said lamp and the rear of said reflector.

5. A lamp as claimed in claim 4, in which said starting device comprises conductive bands respectively substantially encircling said stems at said first and second junction points.

6. A lamp as claimed in claim 1, in combination with a concave reflector having an optical light projection axis, said stems of the lamp extending from opposite ends of said bulb portion and lying on a common axis, said lamp being mounted in said reflector along said optical axis with said first electrode structure relatively toward the front of the reflector and said second electrode structure relatively toward the rear of the reflector, and a current conductor connected to said first electrode structure and extending between said lamp and said reflector toward the rear of the reflector, said starting device comprising an elongated conductor positioned between said lamp and said current conductor and aligned with respect to said current conductor so that shadows of said starting device elongated conductor and said current conductor will substantially coincide when the lamp is operated.

7. A lamp as claimed in claim 6, in which said starting device comprises conductive bands respectively substantially encircling said stems at said first and second junction points.

* * * * *